US005826476A

United States Patent [19]

Meier

[11] Patent Number: 5,826,476

[45] Date of Patent: Oct. 27, 1998

[54] APPARATUS FOR TRIMMING FOLDED PRINTED PRODUCTS, SUCH AS NEWSPAPERS, PERIODICALS, BROCHURES AND THE LIKE

[75] Inventor: Jacques Meier, Hinterer Engelstein, Switzerland

[73] Assignee: Ferag AG, Hinwil, Switzerland

[21] Appl. No.: 678,521

[22] Filed: Jul. 9, 1996

[30] Foreign Application Priority Data

Jul. 11, 1995 [CH] Switzerland ..... 02019/95

[51] Int. Cl.[6] ..... B26D 7/02; B26D 7/06; B26D 1/12; B26D 1/62

[52] U.S. Cl. ..... 83/155; 83/404.2; 83/409.1; 83/407; 83/418; 83/425.1; 83/934

[58] Field of Search ..... 83/934, 404.2, 83/407, 409.1, 418, 425.1, 35, 39, 411.1, 411.3, 411.5, 422, 431, 155

[56] References Cited

U.S. PATENT DOCUMENTS

| | | | |
|---|---|---|---|
| 1,177,146 | 3/1916 | Sheehan | 83/407 |
| 2,245,868 | 6/1941 | Melby | 83/409.1 |
| 3,496,816 | 2/1970 | Doerfler et al. | 83/404 X |
| 3,811,350 | 5/1974 | Marciniak | 83/39 |
| 3,884,102 | 5/1975 | Faltin | 83/934 X |
| 4,030,394 | 6/1977 | Kistner et al. | 83/934 X |
| 4,038,893 | 8/1977 | Reist | 83/154 |
| 4,046,043 | 9/1977 | Kistner et al. | 83/934 X |
| 4,201,286 | 5/1980 | Meier | 198/461 |
| 4,294,345 | 10/1981 | Stauber et al. | 198/683 |
| 4,669,347 | 6/1987 | Worner | 83/422 |
| 4,669,644 | 6/1987 | Nilsson | 83/408 X |
| 4,793,227 | 12/1988 | Stobb | 83/934 X |
| 4,981,291 | 1/1991 | Honegger et al. | 270/55 |
| 5,052,666 | 10/1991 | Hansch | 270/55 |
| 5,052,667 | 10/1991 | Hansch | 270/55 |
| 5,113,731 | 5/1992 | Reist | 83/934 X |
| 5,169,139 | 12/1992 | Stauber et al. | 198/470.1 X |
| 5,501,127 | 3/1996 | Stauber | 83/934 X |
| 5,503,051 | 4/1996 | Stauber | 83/934 X |

FOREIGN PATENT DOCUMENTS

| | | |
|---|---|---|
| 686463 | 12/1995 | European Pat. Off. . |
| 668216 | 12/1988 | Switzerland . |
| 685153 | 4/1995 | Switzerland . |

*Primary Examiner*—Rinaldi I. Rada
*Assistant Examiner*—Boyer D. Ashley
*Attorney, Agent, or Firm*—Bell Seltzer; Intellectual Property Law Group of Alston & Bird LLP

[57] ABSTRACT

An apparatus for trimming printed products which includes a drum with a plurality of radially displaced receiving compartments. The printed products which are to be trimmed rest, along their folded edges, against stops which form the base of the radial receiving compartments. The products are gripped by a displacement device and displaced radially outwards into a cutting position. In the cutting position, the printed products are clamped in the region of their side border located opposite the fold edge. When the clamped printed products run past a stationary cutter element, the printed products are trimmed on the side border. After completion of the cutting operation, the clamping of the printed products is released and the displacement device is moved by a further distance radially outwards. Consequently, the trimmed printed products are advanced into a removal position, in which they are gripped by grippers of a removal conveyor. The controlled advancement of the printed products both into the cutting position and into the removal position ensures that the printed products can be trimmed and received by the grippers of the removal conveyor in precisely defined positions along the printed products.

16 Claims, 8 Drawing Sheets

APPARATUS FOR TRIMMING FOLDED PRINTED PRODUCTS, SUCH AS NEWSPAPERS, PERIODICALS, BROCHURES AND THE LIKE

FIELD OF THE INVENTION

The present invention relates to an apparatus for trimming folded, in particular multi-sheet, printed products, e.g. newspapers, periodicals and brochures, at least on the side border parallel to the fold edge.

BACKGROUND OF THE INVENTION

An apparatus generally related to the present invention is disclosed in EP-A-0 367 715 and the corresponding U.S. Pat. No. 5,113,731. According to that apparatus, the receiving compartments are driven in rotation around a common, horizontal axis and extend in the radial direction. The receiving compartments are open on the circumference and on the two end sides of the apparatus, which is designed as a processing drum. The printed products which are to be trimmed are introduced into the receiving compartments, through the receiving-compartment openings arranged on the drum circumference, with their fold edge in front and drop onto the folding-compartment base, the latter serving as support. Controllable clamping arrangements which clamp the printed products at least during the cutting operation are provided in the receiving compartments.

For the trimming of the printed products on the side border located opposite the fold edge and parallel thereto, the clamping arrangements are released when the receiving compartments, during their rotational movement around the axis of rotation, extend downwards. The temporarily released printed products slide outwards and abut, by means of their side border which is to be trimmed, against a stop which is at a small spacing from the circumference of the processing drum. The printed products are then clamped again. Subsequently, the printed products, which are now projecting some way beyond the opening of the receiving compartments, are moved past a stationary cutter element which interacts with a cutter element which is arranged at the opening of the receiving compartments and rotates along with the latter. The projecting border strip is cut away by the interaction of the two cutter elements. As the receiving compartments continue to rotate, the trimmed, no longer clamped printed products slide out of the receiving compartments and are transported away by a removal conveyor.

In order to move the printed products into the correct cutting position for the trimming of the side border parallel to the fold edge, the side border usually being an open side border, the printed products, as has already been mentioned, are conveyed out of the receiving compartments, under the action of gravitational and centrifugal forces, and against a stop. This may, on one hand, result in damage to the side edge which is to be trimmed and also, in the case of multipart printed products, in the individual printed-product parts, which are located one inside the other, slipping with respect to one another. Since the ready-trimmed printed products are also conveyed out of the receiving compartments under the action of gravitational and centrifugal force, it is not ensured that the finished printed products will be received by the removal conveyor in the correct position.

A similar prior art apparatus for trimming printed products is described in EP-A-0 602 594. In the case of this apparatus, the receiving compartments of a first processing drum rotate around a vertical axis of rotation. The printed products which are to be trimmed are fed in a hanging position with their fold edge downwards and are allowed to drop into the receiving compartments, which are open at the bottom. In order to position the printed products in the cutting position, there is provided beneath the processing drum, a support which is separate from the drum and against which the printed products come to rest by means of their fold edge. After the trimming of the side border located opposite the fold edge, the printed products drop, again under the action of gravitational force, into the receiving compartments of a second processing drum, having a horizontal axis of rotation, in which the printed products are trimmed on the side borders running at right angles with respect to the fold edge.

Finally, CH-A-685 153 discloses a comparable type of cutting apparatus which likewise has a processing drum with radially running receiving compartments which are open on the circumference and on the end sides. The printed products which are to be trimmed are introduced into the receiving compartments with their side border which is to be trimmed, these being located opposite the fold edge, in front and are allowed to drop against a stop. The printed products, which rest against the stop by means of their side border which is to be trimmed, assume a standby position, from which, at a suitable point in time, the printed products are displaced, by means of a displacement device, radially towards the axis of rotation and into the cutting position. In this arrangement, the displacement device grips the printed products on the fold edge. After the subsequent trimming of the side borders at right angles with respect to the fold edge, during which the printed products continue to be gripped by the displacement device, the printed products are displaced outwards again and, in the upper region of the processing drum, are removed from the receiving compartments by means of a removal conveyor running above the processing drum. The removal conveyor has grippers which are arranged at regular intervals one behind the other and grip the printed products on the fold edge.

SUMMARY OF THE INVENTION

An object of the present invention is to provide an apparatus of the general type mentioned above wherein printed products are moved into proper position for trimming the side border parallel to the fold edge and, if appropriate, also the side borders running at right angles with respect to the same, and also for being received by the removal conveyor.

This object is achieved by providing an apparatus for trimming folded printed products at least on the side border thereof parallel to the folded edge. The apparatus includes receiving compartments which are rotatably driven and which are open at least on one side running transverse to the direction of rotation to receive the printed products to be trimmed. Within each receiving compartment is a support for supporting the folded edge and a controllable clamping arrangement for clamping the printed products during cutting. On the open sides of the receiving compartments is positioned a cutter element which moves along therewith and interacts with a stationary cutter element for trimming the side borders of the printed product. Also within the receiving compartments is a controllable displacement device which, during movement, moves the seized product away from the support into the cutting position and then to a discharge position in which the conveyor removes the printed and trimmed products.

Since a displacement device, the movement path of which is precisely defined, is provided for the displacement of the printed products from their initial position, which they assume by way of their fold edge bearing on the support, into the cutting position, the printed products are always displaced into the correct cutting position without their being any danger, in the case of multi-part printed products, of the individual product parts shifting with respect to one another. The same displacement device then moves the trimmed printed products into the removal position, which is likewise precisely defined, with the result that the printed products can be received by the removal conveyor in a controlled manner, which is particularly advantageous, in particular, in the case of removal conveyors which have grippers.

BRIEF DESCRIPTION OF THE DRAWINGS

An exemplary embodiment of the subject matter of the invention is explained in more detail hereinbelow with reference to the drawings, in which, purely schematically.

DETAILED DESCRIPTION OF THE PREFERRED EMBODIMENTS

Figure 1:
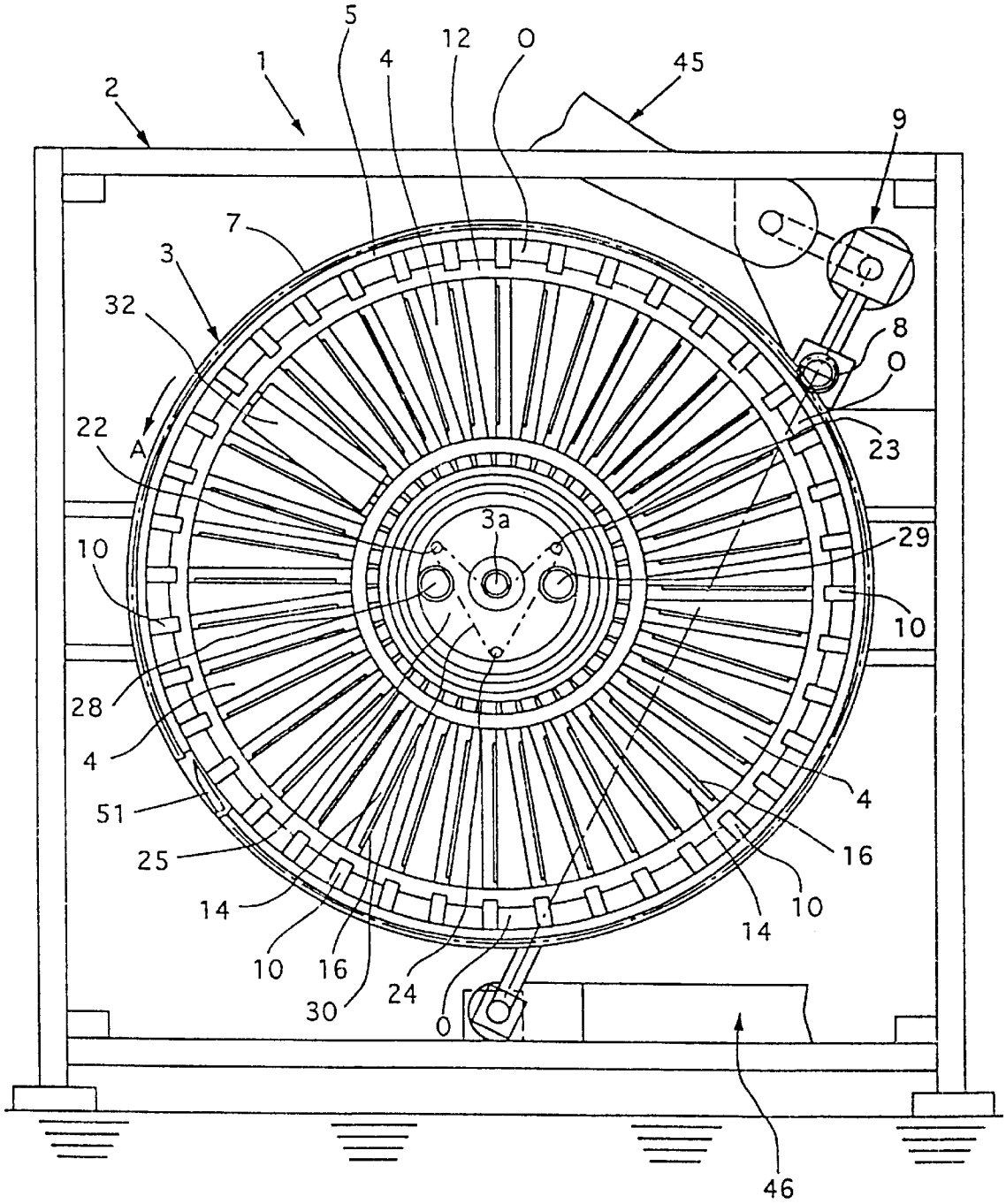
FIG. 1 shows a side view of an apparatus according to the present invention.

FIGS. 1–4 are used hereinbelow to explain the construction of the novel apparatus 1 for trimming folded printed products on three side borders. Thereafter, FIGS. 5–9 are used to describe design details of the apparatus 1.

The apparatus 1 for trimming printed products has a processing drum 3 which is mounted rotatably in a framework 2. The longitudinal axis of the processing drum 3 is designated by 3*a*. The processing drum 3 has a number of receiving compartments 4, which run radially and are open both on the circumference and on the two end sides of the processing drum 3. The circumferential opening of the compartments 4 is designated by O. As FIGS. 1–4 show, the processing drum 3 has two outer rings 5 and 6 which are coaxial with the drum longitudinal axis 3*a* and are provided on their circumference with a toothed rim 7. Each of these toothed rims 7 meshes with a drive pinion 8 (FIGS. 1 and 4) which is driven by a drive 9 mounted in the framework 2. The two outer rings 5 and 6, which are spaced apart in the axial direction, are connected to one another via connecting struts 10 which extend in the direction of the longitudinal axis 3*a* and are, for example, screwed to the outer rings 5, 6. The number of connecting struts 10 corresponds to the number of compartments 4. As can be seen from FIG. 3, the connecting struts 10 comprise two strut parts 10*a* and 10*b*, which are spaced apart from one another by spacer elements 11.

Arranged within the interior formed by the outer rings 5, 6 and the connecting struts 10 are two inner rings 12 and 13, which likewise run coaxially with the drum longitudinal axis 3*a*. The inner rings 12, 13 can be displaced in the direction of the drum longitudinal axis 3*a* in a manner which is yet to be described and are in entrainment connection with the connecting struts 10, with the result that, upon rotation of the outer rings 5 and 6, the inner rings 12, 13 are entrained in the direction of rotation A. The entrainment and displacement connection between the inner rings 12 and 13 and the connecting struts 10 is ensured in that the connecting struts 10, i.e. the strut part 10*b*, engage into a groove on the circumference of the inner rings 12, 13. These grooves are designated by 12*a* in FIG. 5. Consequently, the inner rings 12, 13, as has been mentioned, can be displaced in the longitudinal direction of the connecting struts 10 and, upon rotation of the outer rings 5, 6, can be entrained.

Figure 2:
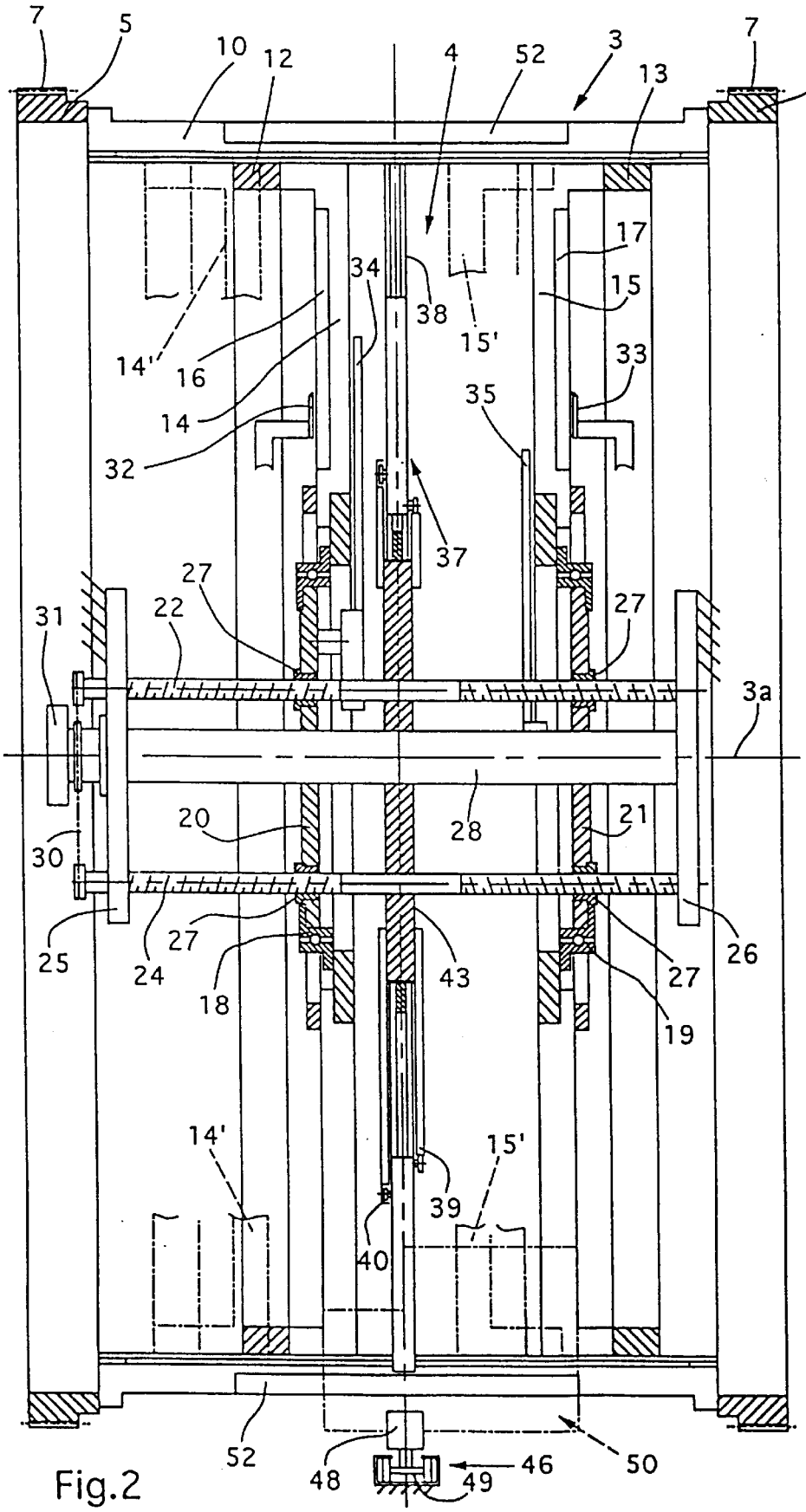
FIG. 2 shows an axial section of the processing drum of the apparatus according to FIG. 1.
Figure 3:
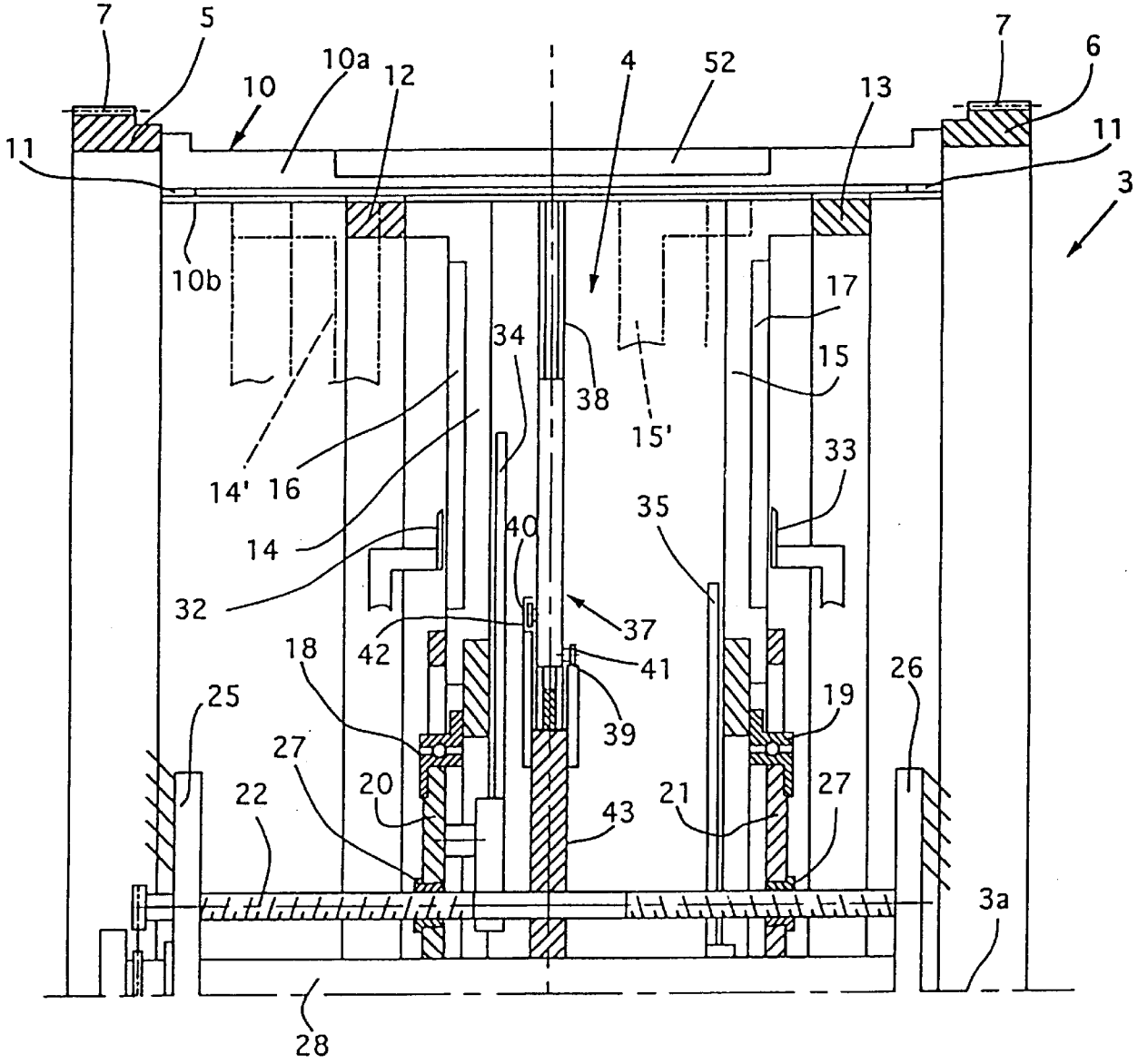
FIG. 3 shows, on an enlarged scale, the top half of the apparatus shown in FIG. 2.

Fastened on the inner rings 12, 13 are supporting elements 14 and 15, respectively, which extend in the radial direction towards the drum axis 3*a*. The supporting elements 14, 15 form part of the partition walls between the receiving compartments 4 and serve as supporting means for the printed products which are to be trimmed, as will be described in more detail later. On the outwardly directed side, the supporting elements 14, 15 are provided with a cutter element 16 and 17, respectively (FIGS. 2 and 3). The supporting elements 14, 15 are mounted rotatably on disc-shaped bearing elements 20, 21 via bearing rings 18, 19 (FIGS. 2 and 3). The bearing elements 20, 21 have three threaded spindles 22, 23, 24 passing through them, which spindles are mounted rotatably in two flanges 25 and 26 which are fastened on the framework 2. The bearing elements 20, 21 are connected to thread sleeves 27 which are seated on the thread spindles 22, 23, 24. Furthermore, two guide rods 28 and 29 pass through the bearing elements 20 and 21. The guide rods 28, 29 are parallel to the threaded spindles 22, 23, 24 and parallel to the drum longitudinal axis 3*a* and are likewise fastened on the flanges 25 and 26. The three threaded spindles 22, 23, 24 are connected to one another via a chain 30 and can be rotated by means of a common adjustment wheel 31.

By virtue of the adjustment wheel 31 being rotated, the bearing elements 20, 21 and, with these, also the supporting elements 14, 15 including the inner rings 12, 13 can be adjusted, via the threaded spindles 22, 23, 24, in the direction of the drum longitudinal axis 3*a*. In this manner, the spacing between the supporting elements 14, 15 (and thus the width of the receiving compartments 4) can be adapted to the width of the printed products which are to be trimmed (format setting). In FIGS. 2 and 3, solid lines show the supporting element 14 in the position for the smallest product width and the supporting element 15 in the position for the largest product width. Dashed lines indicate the supporting element 14' in the position for the largest product width and the supporting element 15' in the position for the smallest product width.

Arranged adjacent to the outwardly directed sides of the supporting elements 14, 15 is in each case one stationary cutter element 32, 33 which is fastened on the bearing element 20 and 21, respectively, and is thus adjusted therewith. The stationary cutter elements 32, 33 are located opposite one another, as seen in the direction of the drum axis 3*a*, and interact with the rotating cutter elements 16, 17 of the supporting elements 14, 15 for the simultaneous trimming of the two mutually opposite open side borders of the printed products. In this arrangement, the cutting operation is similar to that for the apparatus described in the already mentioned EP-A-0 602 594.

Arranged between the supporting elements 14, 15 of the receiving compartments 4, which supporting elements are in alignment with one another in the circumferential direction of the processing drum 3, are two supports 34, 35 (FIGS. 2–4) which are designed in the manner of segments, are stationary, extend in the direction of rotation A and form the lower boundary of the receiving compartments 4 in the region of introduction of the printed products into the receiving compartments 4. The two supports 34, 35 can be adjusted in the radial direction by means of an adjustment mechanism 36 (FIG. 4) in order for it to be possible to set the depth of the receiving compartments 4 to correspond to the height of the printed products which are to be trimmed. FIG. 3 shows the support 34 in the position for printed products of the smallest height, while the other support 35 is represented in the position for printed products of the greatest height.

Furthermore, a displacement device 37 is arranged in each compartment, and this displacement device will be described in more detail with reference to FIG. 9. The displacement device 37 is arranged in each case between the supporting elements 14, 15 of each receiving compartment 4. The displacement device 37 can be displaced in the radial direction along a linear guide 38, as has yet to be described in more detail. Provided for the control of the opening and closing movements of the displacement device 37 and the radial displacement of the latter are two control cams 39 and 40, with which control rollers 41 and 42 arranged on the displacement device 37 interact. The control cam 40 is designed such that the control rollers 42 are guided positively. The two control cams 39, 40 are fastened on a carrying part 43 which is arranged in a stationary manner in the framework 2.

Furthermore, a clamping device 44 is provided in each receiving compartment 4, which clamping device, for the sake of clarity, is not shown in FIGS. 1–3 and has its construction explained in more detail with reference to FIGS. 5–8. The clamping device 44 interacts with the supporting elements 14, 15 in order to clamp the printed products during trimming of the two mutually opposite, usually open, side borders. In addition, the clamping device 44 is also used in order to clamp the third side border, running parallel to the fold edge, during the cutting operation, as will be described in more detail with reference to FIGS. 5–8.

Figure 4:
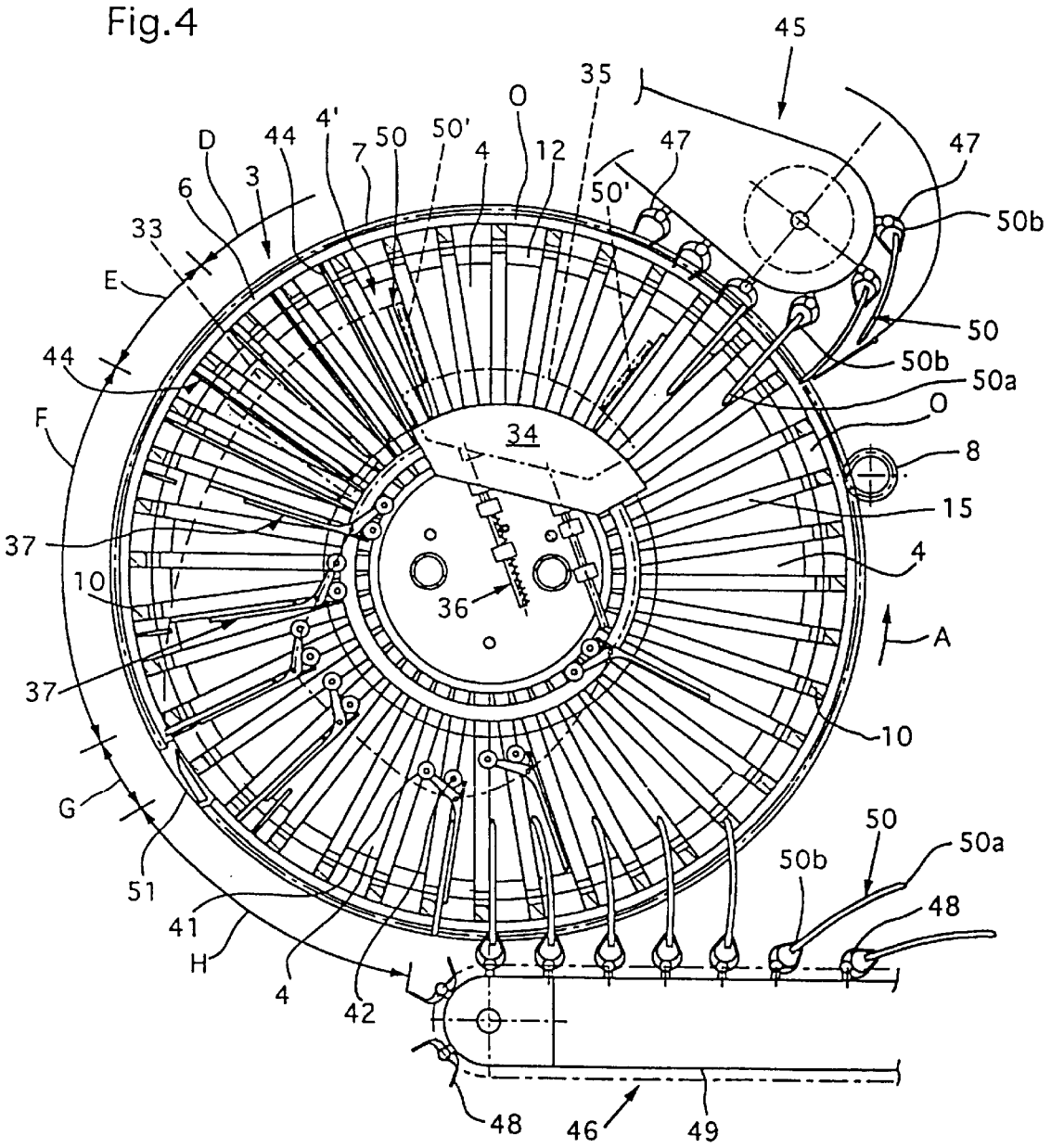
FIG. 4 shows a cross-section of the processing drum of the apparatus according to FIG. 1.

As can further be seen from FIGS. 1 and 2, the processing drum 3 is assigned a feed conveyor 45 and a removal conveyor 46, these two being driven by the drive 9. Both the feed conveyor 45 and the removal conveyor 46 have controlled grippers 47 and 48, respectively, which are spaced apart one behind the other on a drawing member 49 which is driven in circulation (FIG. 4). The feed conveyor 45 is used for feeding and introducing into the receiving compartments 4 the folded printed products 50 which are to be trimmed. In this arrangement, the usually multi-part printed products 50 are introduced into the receiving compartments 4 with their fold edge 50*a* in front. Consequently, the printed products 50 are retained by the grippers 47 on the open side border 50*b* located opposite the fold edge 50*a*. The grippers 48 of the removal conveyor 46 again grip the ready-trimmed printed products 50 on the open side border 50*b* located opposite the fold edge 50*a*.

Provided for the trimming of the abovementioned open side border 50*b* is a stationary cutter element 51, which is represented only schematically in FIGS. 1 and 4 and is arranged on the circumference of the processing drum 3.

A printed product 50' of relatively small height is shown by dashed lines in FIG. 4. The abovementioned adjustment of the supports 34, 35 achieves the situation where the side border 50*b* always assumes the same position at the beginning of the cutting operation irrespective of the height of the printed products 50 or 50', i.e., always spaced apart by the same distance from the drum longitudinal axis 3*a*. This situation is represented in FIG. 4 in the receiving compartment designated by 4'. This thus achieves the situation where, irrespective of the format of the printed products 50, the latter can always be advanced by the same distance in the radial direction in order to pass into the correct position for the trimming of the side border 50*b*.

As can be seen from the representations in FIGS. 2, 3, 5 and 9, the strut parts 10*a* of the connecting struts 10 are provided on their leading edge, as seen in the direction of rotation A, with an elongate cutter element 52 which interacts with the stationary cutter element 51 for the trimming of the printed products 50 on the open side border 50*b* located opposite the folded edge 50*a* of the printed products. The side border 50*b* is trimmed in a similar manner as in the case of the apparatus in accordance with the already mentioned EP-A-0 602 594.

The construction of the clamping device 44 will now be described hereinbelow with reference to FIGS. 5–8.

Figures 5, 6:
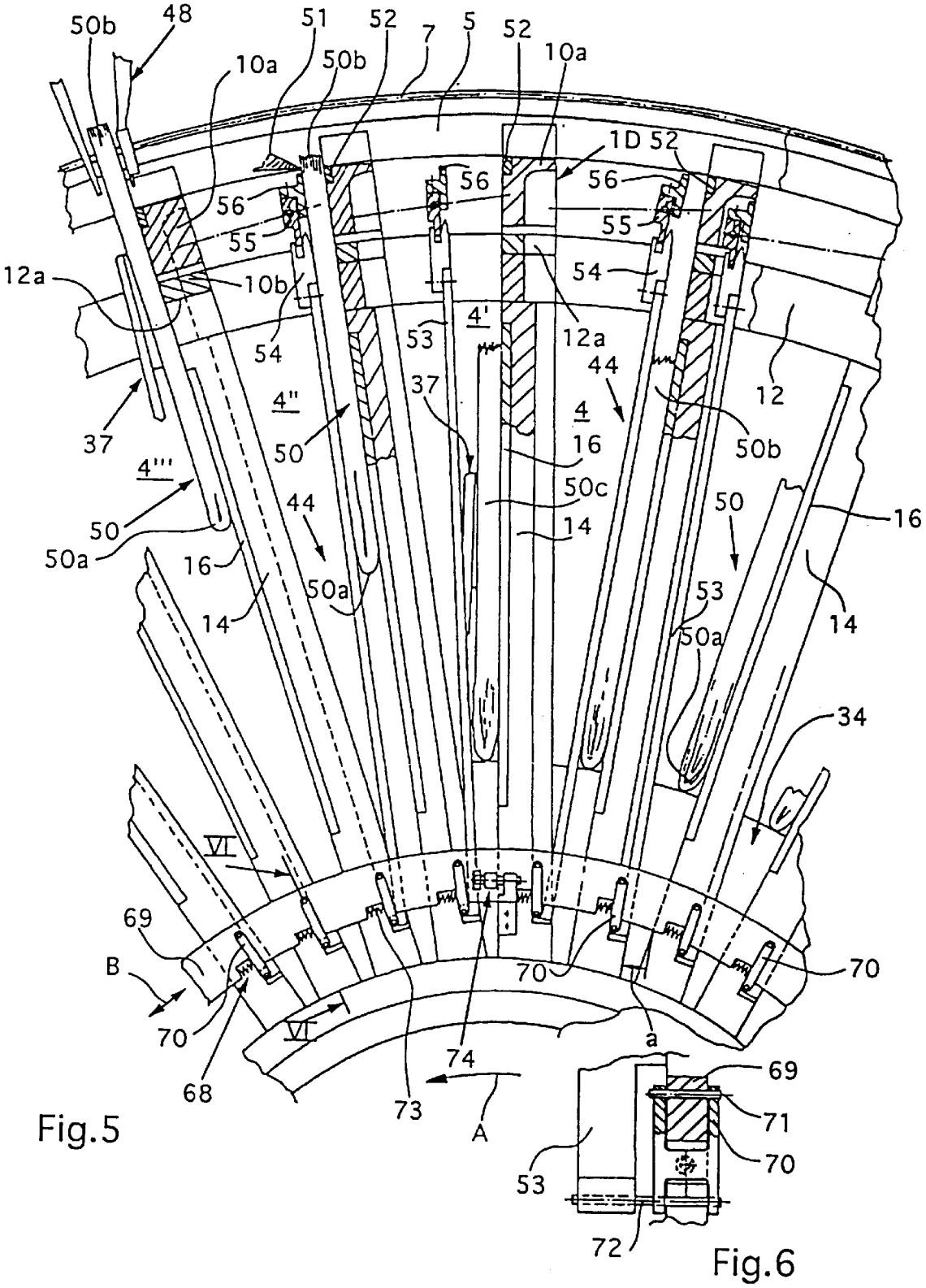
FIG. 5 shows, on an enlarged scale with respect to FIG. 4, a cross-section of a number of receiving compartments of the processing drum in various operating phases.
FIG. 6 shows a sectional view taken along line VI—VI in FIG. 5.

Each clamping device 44 comprises two flat pressing elements, of which only one pressing element 53 can be seen in FIG. 5. Each pressing element 53 interacts with a supporting element 14, 15. The open side borders running at right angles with respect to the fold edge 50*a*, it being possible to see only one side border 50*c* in FIG. 5, are clamped, for the purpose of the cutting operation, between a pressing element 53 and the associated supporting element 14, 15. At the radially outer end, each pressing element 53 has a guide member 54 which is firmly connected to it. The pressing elements 53 with the associated guide members 54 can be displaced, together with the supporting elements 14 and 15 and the inner rings 12 and 13, in the direction of the drum longitudinal axis 3*a* for the purpose of format setting. Each guide member 54 has a groove 54*a* into which a connecting member 55 engages by means of an extension 55*a*. The connecting member extends over the entire width of a receiving compartment 4 and connects the guide members 54 of the two pressing elements 53 assigned to the same receiving compartment 4. The extension 55*a* is used as a guide element for the axial displacement of the pressing element 53 and guide member 54. A pressing strip 56 which likewise extends over the entire width of the receiving compartments 4 is connected to the connecting member 55. For clamping the printed products on the open side border 50*b*, the pressing strip 56 interacts with the facing surface of the strut part 10*a* of the connecting struts 10. The surface of the connecting struts 10 is located in the same plane as the supporting surfaces of the supporting elements 14 and 15.

Figure 7:
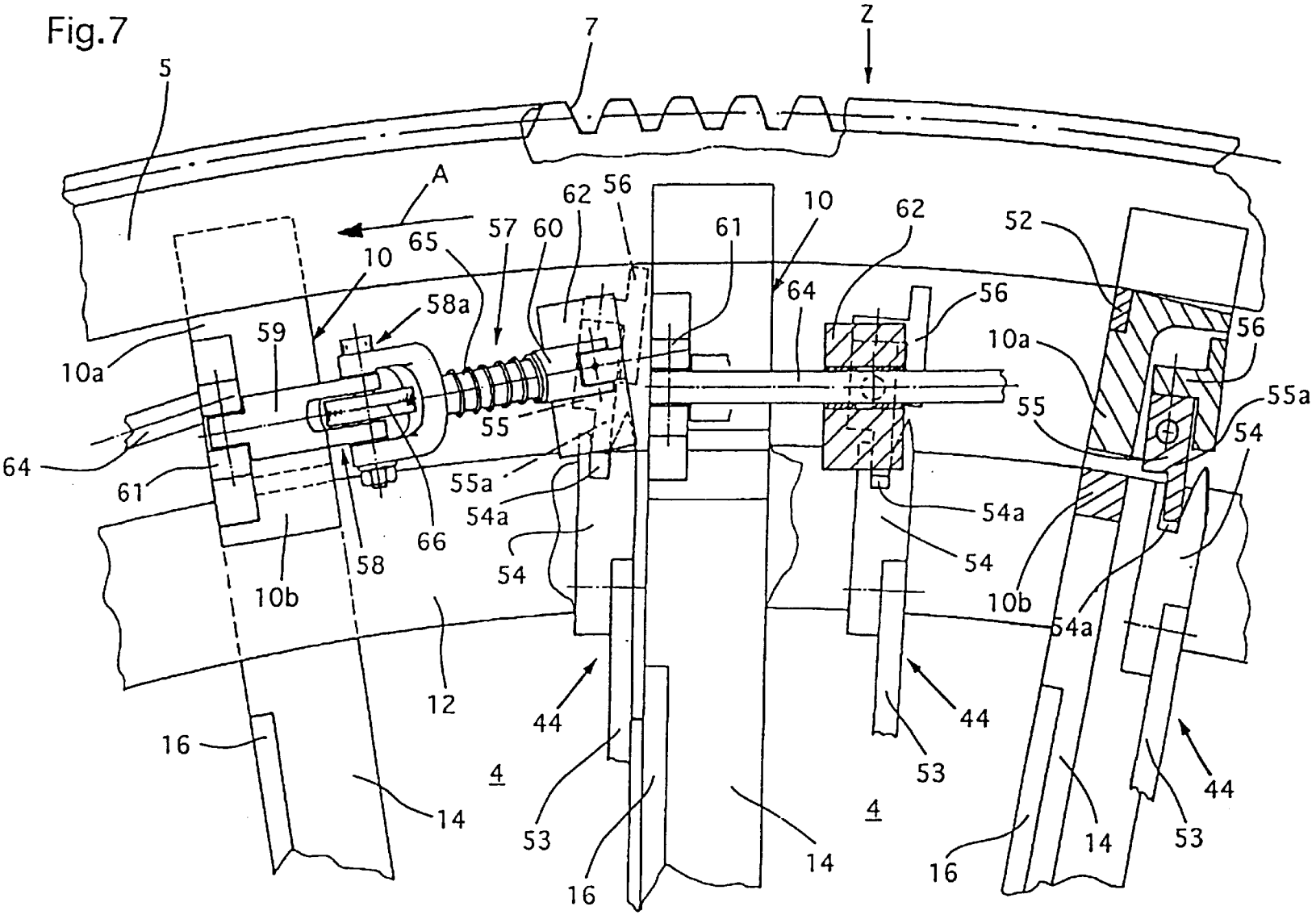
FIG. 7 shows, on an enlarged scale, a detail view of the circumferential region of the processing drum.
Figure 8:
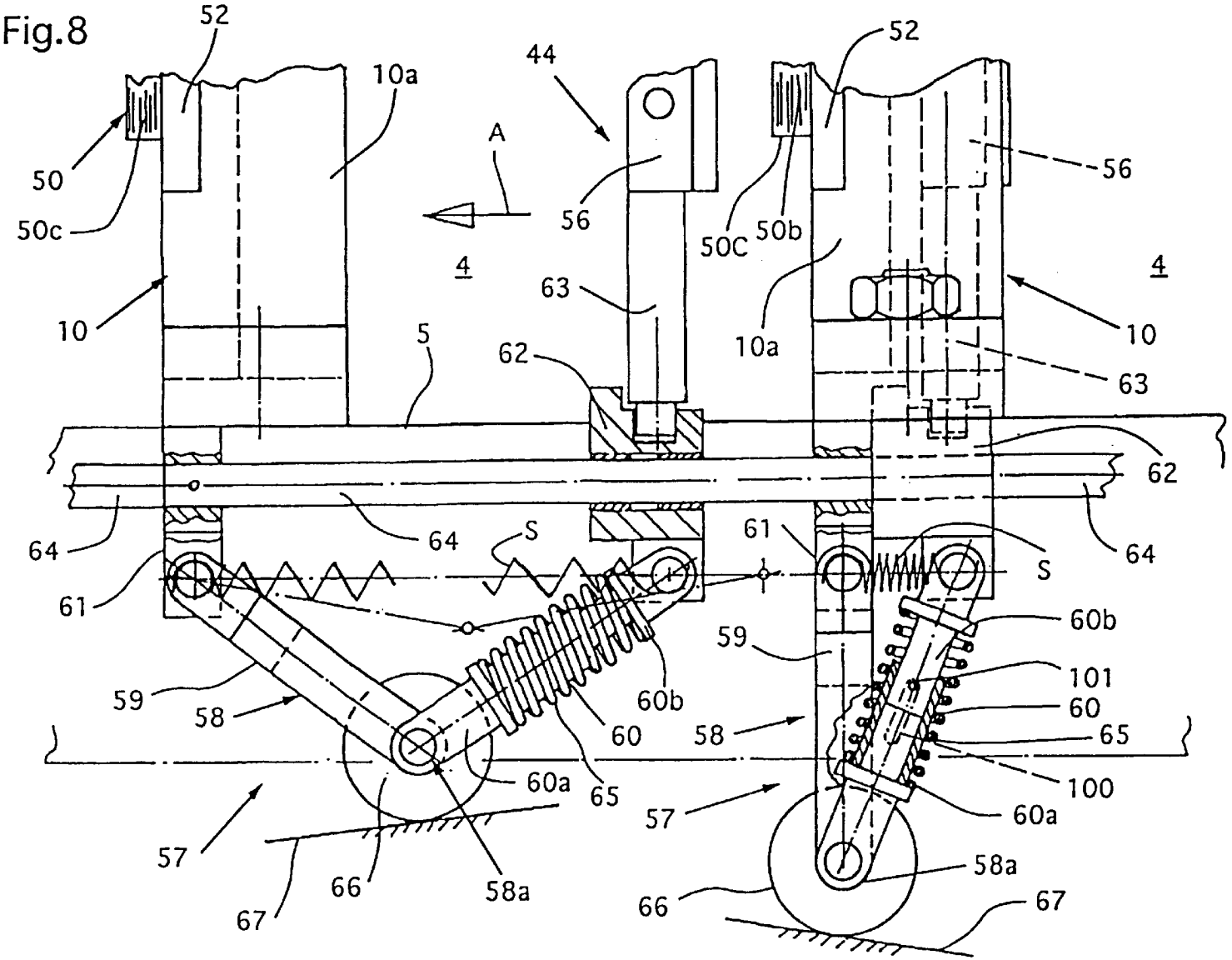
FIG. 8 shows a plan view of the processing drum in the direction of the arrow Z in FIG. 7.

An actuating mechanism 57, which is represented in more detail in FIGS. 7 and 8, is provided on both sides of the processing drum 3 in order to move the clamping devices between a rest position and a clamping position. The actuating mechanism 57 has a toggle lever 58, the joint of which is designated by 58*a*. One lever 59 of the two levers 59, 60 of the toggle lever 58 is fastened in an articulated manner on an anchoring element 61 which is fastened on the outer ring 5 or 6 or on a connecting strut 10. The other lever 60 is connected in an articulated manner to a slide element 62 which is in connection with the connecting member 55 via a connecting element 63. Each slide element 62 is mounted displaceably on a guide rod 64 which extends between adjacent anchoring elements 61 and is connected thereto.

The lever 60 of the toggle lever 58 comprises two parts 60*a* and 60*b*. The lever part 60*b* engages telescopically into the other lever part 60*a* (see FIG. 8). A compression spring 65 is clamped in between the lever parts 60*a* and 60*b*, and this spring permits adaptation to printed products of different thicknesses. Provided on the joint 58*a* of the toggle lever 58 is a follow-on roller 66 which can be rotated around the joint axis. The follow-on roller 66 interacts with a stationary control cam 67, which is indicated only schematically in FIG. 8. As FIG. 8 likewise shows, the lever part 60*a* is provided with a slot 100 in which there is guided a pin 101 which is fastened on the other lever part 60*b*. Clamped between the slide element 62 and the anchoring element 61 for the associated toggle lever 58 is a tension spring S which has the tendency of drawing the clamping device back into the rest position, which is shown for the receiving compartment 4 on the right-side in FIGS. 5, 7 and 8.

The mode of functioning of the actuating mechanism 57 can be readily derived with reference to FIG. 8. In order to move the clamping device 44, i.e., the pressing element 53 and the pressing strip 56, from the rest position into the clamping position, the toggle lever 58 is moved into the extended position by means of the control cam 67, as is represented on the left in FIG. 8. The tension spring S is stressed thereby. The tension spring S then ensures that the clamping device 44 is moved back into the rest position again as soon as this is made possible by a corresponding arrangement of the control cam 67.

The clamping device 44, i.e. the pressing element 53, can be adapted, in terms of its position with respect to the associated supporting element 14, 15, to the thickness of the printed products 50 which are to be trimmed in each case. For this purpose, use is made of a setting mechanism 68, which is represented in FIGS. 5 and 6. The setting mechanism 68, which is arranged on the two end sides of the processing drum 3, has a setting ring 69 which can be rotated in the direction of the arrow B in a manner which is not shown in any more detail. Mounted in an articulated manner on the setting ring 69 are connecting members 70 which are each assigned to a clamping device 44 and are designed in the manner of a link plate, as can be seen from FIG. 6. The connecting members 70 are connected to the setting ring 69 by means of an articulation bolt 71 (FIG. 6). The opposite end of the connecting members 70 is connected in an articulated manner to the associated pressing element 53 via a further articulation bolt 72. The connecting members 70 are under the action of a compression spring 73 which is supported, at the other end, on the setting ring 69. An arresting device 74 is provided for the guidance and blocking of the setting ring 69. By virtue of the setting ring 69 being rotated, the spacing between the pressing elements 53 and the associated supporting elements 14, 15, this spacing being indicated by a in FIG. 5, can be changed in order thus to take account of the different thicknesses of the printed products 50 which are to be clamped.

The construction of the displacement device 37 will now be explained in more detail with reference to FIG. 9.

The displacement device 37 has a clamping member 75 which is fastened pivotally on a mounting part 76. The latter can be displaced along the linear guide 38. An actuating lever 77 is connected to the clamping member 75, and the control roller 41 which has already been mentioned with reference to FIGS. 2 and 3 is mounted at the end of the actuating lever 77. The clamping member 75 is retained in the clamping position by means of a compression spring 78. The compression spring 78 is arranged between the clamping member 75 and a supporting element 79 which is used as a supporting means for the printed products 50. The supporting element 79 is fastened both on the mounting part 76 and on a second mounting part 80, which can likewise be displaced along the linear guide 38. The control roller 42 is also fastened on the supporting element 79, which control roller is, as has already been mentioned, guided positively by the control cam 40.

Figure 9:
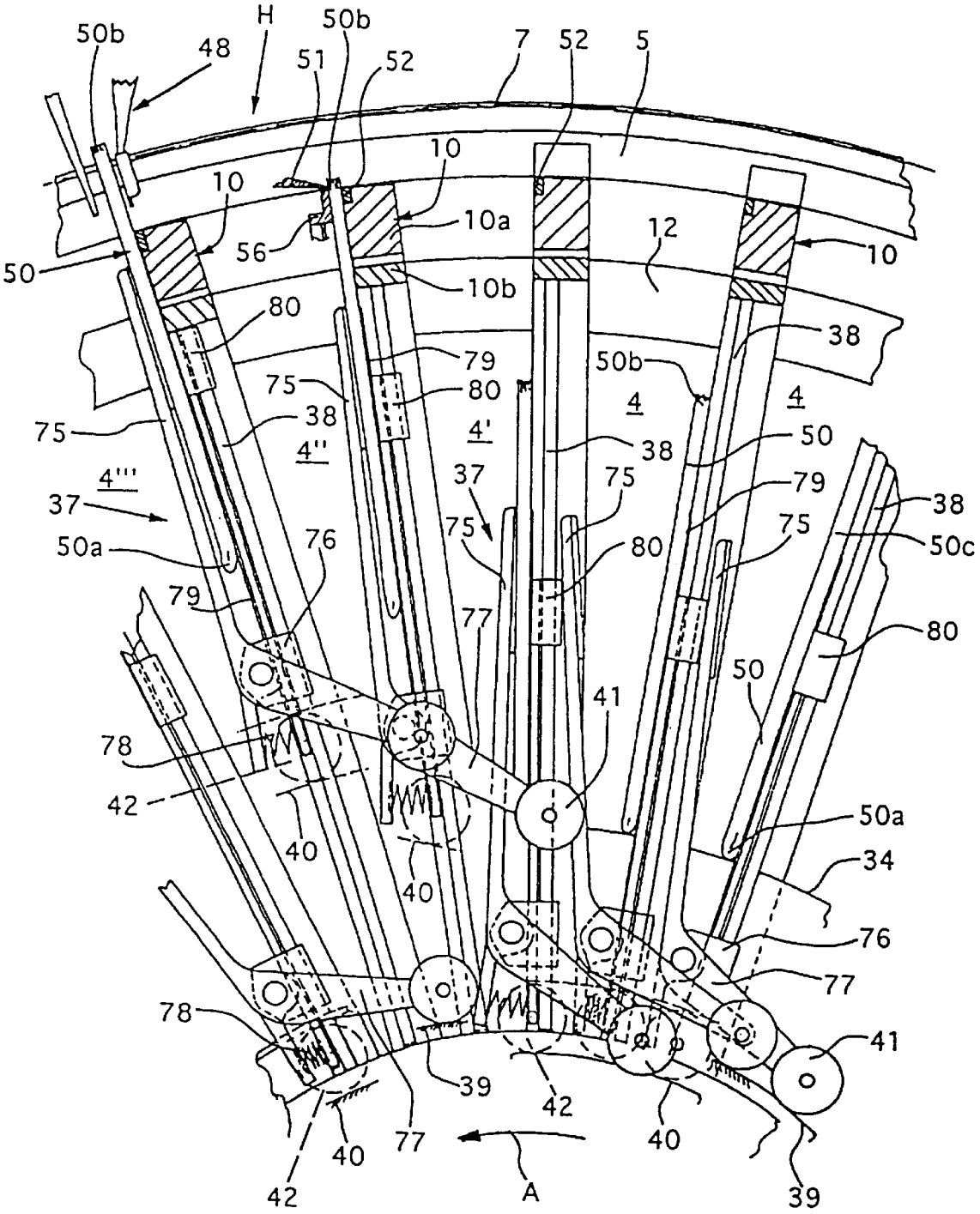
FIG. 9 shows, in a representation corresponding to FIG. 5, a number of receiving compartments in another sectional plane.

The mode of operation of the displacement device 37 can be readily seen from FIG. 9. The control cam 39 acting on the control roller 41 forces the clamping member 75, counter to the force of the compression spring 78, into the open position, this permitting introduction of a printed product between the clamping member 75 and the associated supporting element 79, as is represented on the right-side of FIG. 9. After the return of the clamping member 75 into the clamping position (left-hand side in FIG. 9), the displacement device 37 is displaced outwards in the radial direction by means of the other control cam 40, to be precise in two steps. The printed product introduced into a receiving compartment 4 assumes a basic position, which is defined by the fold edge 50*a* butting against the supports 34, 35 (see right-hand side of FIG. 9). In the basic position, the printed product 50 is clamped in the displacement device 37 located in the initial position. This state is represented in the receiving compartment designated by 4'. In a first step, the printed product is then moved from the basic position into the cutting position, to be precise by displacement of the displacement device 37, i.e. the clamping member 75, out of the initial position into a first operating position. This state is represented in FIG. 9 in the receiving compartment designated by 4". In this cutting position, the side border 50*b* which runs parallel to the fold edge 50*a* is trimmed. In a second step, the trimmed printed product 50 is advanced from the cutting position into a removal position. This is achieved by displacement of the displacement device 37 or of the clamping member 75 from the first operating position into a second operating position, which is represented in the receiving compartment designated by 4"'. In this removal position, the printed product 50 projects beyond the receiving compartments 4 by means of its side border 50*b* and can be gripped by the grippers 48 of the removal conveyor 46. In this second operation position, the clamping member 75 is, of course, moved out of the clamping position into the open position.

The mode of functioning of the apparatus 1, insofar as this is not obvious from what has gone before, will now be explained hereinbelow, reference being made, in particular, to FIGS. 4, 5 and 9.

The printed products 50 fed to the feed conveyor 45 are introduced into the receiving compartments 4 and butt, by means of their fold edges 50*a*, against the supports 34 and 35. As has already been mentioned, the fold edges 50*a* are set such that the side borders 50*b* located opposite the fold edges 50*a* are always located at the same level irrespective of the format of the printed products 50. As the processing drum 3 continues to rotate, the printed products are aligned laterally in a manner which is not shown in any more detail. This alignment region is designed in FIG. 4 by D. Before the printed products 50 run off the supports 34 and 35, they are clamped in their basic position by means of the clamping device 44. Subsequently, the clamped printed products 50 run past the stationary cutter elements 32 and 33 located opposite one another in the axial direction. In this process, the side borders 50*c* running at right angles with respect to the fold edge 50*a* are simultaneously trimmed (so-called head and foot trimming). The corresponding first cutting region is designated in FIG. 4 by E.

After that, the printed products 50 are gripped by the displacement device 37, that is, the clamping member 75 is displaced into the clamping position. The clamping device 44, on the other hand, is opened (see also the corresponding representations in those receiving compartments in FIGS. 5 and 9 which are designated by 4'). This is followed by the commencement of the movement of the displacement device 37 from the initial position into the first operating position, in which the printed products 50 are located in a second cutting position (region F, FIG. 4). In this second cutting region F, the printed product 50 is clamped again by means of the clamping device 44, with the result that the border 50*b* which is then to be trimmed is clamped between the pressing strip 56 and the associated connecting strut 10. This is represented in FIGS. 5 and 9 in the receiving compartments designated by 4". In this first cutting position, the stationary cutter element 51 then interacts with the cutter element 52 in order to trim the side border 50*b* (so-called face trimming). This takes place in the region designated by G in FIG. 4.

Thereafter, the clamping device 44 is released again and the displacement device 37 is then displaced from the first operating position into the second operating position. In the process, the then ready-trimmed printed product is advanced into the removal position, in which it projects out of the circumferential opening O of the receiving compartment 4 and can be gripped by the grippers 48 of the removal conveyor 46. This displacement into the removal position is represented in FIGS. 5 and 9 in the receiving compartments designated by 4''' and takes place in the region designated by H in FIG. 4. In order to ensure that the trimmed printed products 50 are received in a satisfactory manner by the grippers 48 of the removal conveyor 46, the spacing between the grippers 48 is smaller than the separation of the receiving compartments.

Since the side borders running at right angles with respect to the fold edge 50*a* are trimmed simultaneously (head and foot trimming), compensation between the forces occurring during cutting is achieved. If there is no need for any head or foot trimming, then the cutter elements 32, 33 can be disengaged.

Since, as has been mentioned, corresponding setting of the supports 34, 35 ensures that, irrespective of the format size, the side edges 50*b* are always spaced apart by the same distance from the longitudinal axis 3*a* of the processing drum 3, the displacement device 37 may always be advanced by the same distance for each format, in order to pass from the initial position into the first operating position and from the latter into the second operating position. This means that the structural outlay for the displacement device 37 is kept as low as possible. The guided displacement of the printed products 50 in the radial direction from a basic position into the second cutting position and, subsequently, into the removal position ensures that the printed products 50 always assume a precisely defined position for the trimming of the side border 50*b* and for removal by the removal conveyor 46.

Instead of providing a processing drum 3 in which the receiving compartments 4 extend in the radial direction and rotate around a horizontal drum axis 3*a*, it is also conceivable to allow the receiving compartments to circulate along a continuous circulatory path with their openings O always directed upwards, as is known, for example, from CH-A-668 216.

The following variants are also possible within the scope of the concept according to the invention:

Use may also be made of a processing drum with a vertical drum axis, the side border 50*b* located opposite the fold edge 50*a* then being trimmed on an end side of the processing drum, as is the case for the apparatus described in the already mentioned EP-A-0 602 594. The side borders 50*c* running at right angles with respect to the fold edge 50*a* are trimmed in a second processing drum, which may be arranged upstream or downstream of the first processing drum.

Of course, it is also possible only to trim the side border 50*b* parallel to the fold edge 50*a* in the depicted processing drum 3 with horizontal axis of rotation 3*a* and to trim the other side borders 50*c* in another apparatus. However, it is obvious that, in comparison with this, the depicted and described apparatus has the advantage of time-saving processing and, in addition, requires a low outlay in terms of equipment.

It is claimed:

1. An apparatus for trimming folded printed products on at least one side border parallel to a fold edge, said apparatus comprising a plurality of receiving compartments which are driven in rotation along a rotary path, said compartments are open on at least a first side extending transversely with respect to a direction of rotation for receiving the printed products which are to be trimmed, said apparatus including a feed conveyor for feeding the printed products to the receiving compartments and a removal conveyor for transporting the trimmed printed products, said receiving compartments comprising a support upon which the fold edge of the printed products introduced into the compartment contact and a controllable clamping device for clamping the printed products during a cutting operation, said receiving compartments further comprising, on said first open side, a cutter element which moves along therewith and interacts with a stationary cutter element for trimming a side border parallel to the fold edge, said plurality of receiving compartments each comprising a controllable displacement device which acts on an associated printed product of said printed products in an associated receiving compartment of said plurality of receiving compartments and means for moving each displacement device in a predetermined direction, wherein each displacement device is moveable from an initial position to a first operating position wherein said at least one side border is trimmed and, further, to a second operating position, wherein the product which has been trimmed is removed from the associated compartment, wherein the displacement device acts on the associated printed product located in the associated receiving compartment during movement from the initial position into the first operating position wherein the printed product is moved away from the support into a cutting position for trimming of the side border parallel to the fold edge and continuously acts on the printed product during subsequent movement in the same direction from the first operating position into the second operating position wherein the trimmed printed product is moved into a discharge position, in which the removal conveyor receives the printed products.

2. An apparatus according to claim 1, wherein said first open side of the receiving compartments is formed by an introduction opening for the printed products which are to be trimmed.

3. An apparatus according to claim 1, wherein said receiving compartments are driven in rotation around a common axis and the compartments extend away from the axis of rotation in a radial direction and said compartments are open on an outer side, extending in a direction of the axis of rotation.

4. An apparatus according to one of claim 1, wherein said support, which defines a base of the receiving compartments, is adjusted in a radial direction wherein spacing between the cutter element of the receiving compartments and the side border, which is to be trimmed of the printed products resting against the support, is substantially maintained for each product format.

5. An apparatus according to claim 3 wherein the support which is arranged in a region of introduction of the printed products into the receiving compartments is displaced in the radial direction, but is otherwise stationary, and said clamping device clamps the printed products before the products are moved out of the region of the support.

6. An apparatus according to claim 1, wherein said receiving compartments are open on a second side which extends at a right angle with respect to said first open side and on which there is arranged, in each case, one cutter element which interacts with the stationary cutter element for trimming side borders of said printed products extending at right angles with respect to the fold edge of the printed products.

7. An apparatus according to claim 6, wherein said two stationary cutter elements are located opposite one another with respect to the direction of rotation of the receiving compartments, so that said side borders of the products are trimmed at substantially simultaneously.

8. An apparatus according to claim 1, wherein each receiving compartment has two supporting elements which are adjusted at right angles with respect to the direction of rotation of the receiving compartments for adapting a mutual position of the supporting elements to a width of the printed products which are to be trimmed.

9. An apparatus according to claim 8, wherein said displacement device is positioned between said two supporting elements.

10. An apparatus according to claim 6, wherein each supporting element on an outer side thereof supports a cutter element, and the stationary cutter elements which interact with the cutter elements are adjustable along with the supporting elements.

11. An apparatus according to claim 3 wherein said supports are positioned on a side of the receiving compartments and are each fastened on a ring which is coaxial with the axis of rotation and are adjustable in the direction of the axis of rotation and are driven in rotation.

12. An apparatus according to claim 11, wherein the rings on an outer circumference are in entrainment connection with connecting struts which extends in the direction of the axis of rotation and can be driven in rotation around the axis of rotation, the rings being displaceable along said connecting struts.

13. An apparatus according to claim 1, wherein each displacement device includes a clamping member which interacts with a pressing element to support the printed products and are adjustable between an open position and a clamping position and, along with the pressing element, are displaced from the initial position into the first and second operating positions.

14. An apparatus according to claim 1 wherein each clamping device has a pressing element which is pivoted from an open position into a clamping position, wherein said pressing device interacts with supporting means which separate the receiving compartments from one another and support the printed products, the pivot axis of the pressing device being adjusted by means of a setting mechanism in a direction away from the supporting means and in a direction towards the same, so that spacing between the pressing device and the supporting means is set depending upon a thickness of the printed products which are to be trimmed.

15. An apparatus according to claim 8 wherein the pressing device has two pressing elements which are adjustable, in the clamping position, with a supporting element and which are in connection with a pressing element extending at right angles with respect to the direction of rotation of the receiving compartments and interacting, in the clamping position, with a pressing element, which is in connection with the supporting elements.

16. An apparatus according to claim 1, wherein the removal conveyor has controllable grippers which are fastened on a member driven in circulation for gripping the printed products on a trimmed side located opposite the fold edge.

* * * * *